US006314900B1

(12) United States Patent
Samuelsen

(10) Patent No.: US 6,314,900 B1
(45) Date of Patent: Nov. 13, 2001

(54) HIGH-VELOCITY RUDDER

(75) Inventor: Arild K. Samuelsen, Tananger (NO)

(73) Assignee: Den Norske Stats Oljelskap A.S, Stavanger (NO)

( * ) Notice: Subject to any disclaimer, the term of this patent is extended or adjusted under 35 U.S.C. 154(b) by 0 days.

(21) Appl. No.: 09/462,749

(22) PCT Filed: Jul. 21, 1998

(86) PCT No.: PCT/NO98/00223

§ 371 Date: Jan. 13, 2000

§ 102(e) Date: Jan. 13, 2000

(87) PCT Pub. No.: WO99/07599

PCT Pub. Date: Feb. 18, 1999

(30) Foreign Application Priority Data

Jul. 23, 1997 (NO) ..... 973396

(51) Int. Cl.[7] ..... B63H 25/06
(52) U.S. Cl. ..... 114/167; 114/162
(58) Field of Search ..... 114/128, 149, 114/162, 163, 164, 167, 172

(56) References Cited

U.S. PATENT DOCUMENTS

| | | | | |
|---|---|---|---|---|
| 31,845 | * | 3/1861 | Winans et al. | 114/163 |
| 367,771 | * | 8/1887 | Witmer | 114/163 |
| 398,900 | * | 3/1889 | Martin | 114/149 |
| 682,476 | * | 9/1901 | Marolf | 114/164 |
| 1,128,508 | | 2/1915 | Quartermaine . | |
| 1,364,961 | * | 1/1921 | Thompson | 114/61.19 |
| 1,582,391 | * | 4/1926 | Flettner | 114/163 |
| 3,080,845 | * | 3/1963 | Pollak | 114/140 |
| 3,326,168 | | 6/1967 | Swiggart, III et al. . | |
| 3,467,045 | | 9/1969 | Broehl . | |
| 4,307,677 | | 12/1981 | Jastram et al. . | |
| 4,342,275 | | 8/1982 | Brix et al. . | |
| 4,434,738 | | 3/1984 | Barkemeyer . | |
| 5,150,661 | * | 9/1992 | Rudolf | 114/26 |

FOREIGN PATENT DOCUMENTS

| | | |
|---|---|---|
| 162452 | 7/1985 | (NO) . |

* cited by examiner

*Primary Examiner*—S. Joseph Morano
*Assistant Examiner*—Andrew Wright
(74) *Attorney, Agent, or Firm*—Foley & Lardner

(57) ABSTRACT

A rudder, especially for water vessels, which in its one end is connected with the vessel's hull (1) and comprising a main rudder blade (3) and rudder flaps (5, 6) arranged to be turnable with respect to the main rudder blade (3). The new traits of the invention are that the main rudder blade (3) is arranged to be in a fixedly anchored centre position with respect to the hull (1), and having two or more rudder flaps (5, 6) mounted leading and trailing on the main rudder blade (3) and arranged to steering the vessel at high speeds, and that the main rudder blade (3) is arranged releasable from its fixedly anchored center position, and arranged to be turnable as a whole in the usual manner, especially for steering the vessel at lower speeds.

12 Claims, 6 Drawing Sheets

HIGH-VELOCITY RUDDER

FIELD OF THE INVENTION

This invention concerns a rudder for water vessels of the kind comprising a main body and one or more rudder wings arranged to be turned with respect to the main body.

Problem

At low speeds the rudder must have a certain size and angle of attack in order to steer a vessel efficiently. However, such a rudder may be unnecessarily large for higher speeds, and cause unwanted drag in the sea and thus lost speed and unnecessarily high fuel consumption. Conventional rudders tend to increase their effect almost proportionally with speed. Large forces are exerted on a rudder that is turned away from the vessel's direction of movement when at high speed. This may lead to damage on the rudder, the rudder stem and the steering engine. During a sudden change of course with a vessel with a conventional rudder at high speed, a loss of speed occurs.

DESCRIPTION OF THE RELATED ART

Several devices comprising ship rudders and centreboard-like rudders with rudder wings are known.

U.S. Pat. No. 1,128,508: "Emergency bow rudder" describes a jury rudder arranged in the bow of a vessel and arranged to be thrusted through the bow by means of hydraulics. This jury rudder is arranged to be used in critical situations, e.g. to avoid collision at sea, or if the main rudder is out of order. The present invention differs from U.S. Pat. No. 1,128,528 which does not have a fixedly anchored main body during active use, in that the embodiment of the present invention comprises a main body which may be drawn in to a fixedly anchored centre position, and in that the active use of rudder wings causes change of the total rudder profile and thus a hydrodynamic rudder effect giving a change of course at high speed.

U.S. Pat. No. 3,326,168: "Retractable rudder for a barge" describes a barge rudder which may be retracted inside an open keel whrereby the rudder is hindered from rotation. Thus the rudder does not work when drawn inside the fixed keel. The purpose and the effect in U.S. Pat. No. 3,326,168 thus completely differs from the present invention whereby the steering effect is entirely present and prepared for high speed, with the main part of the rudder main body partly drawn back into a rudder blade lock attachment on the hull. U.S. Pat. No. 3,326,168 neither shows nor mentions any kind of movable rudder wings.

U.S. Pat. No. 4,342,275: "Fin rudder for ships" deal with an ordinary ship rudder with one or more flaps at the trailing or astern part of the rudder blade, with the flaps arranged to be rotated about a vertical axle, and arranged to be locked in a fixed position in the main rudder blade.

Norwegian patent 162 452 "High-effect fin rudder for water vessels", describes a ship rudder with an additional flap which by means of a pivoted gear connection to the flap automatically provides an additional movement of the flap with respect to the rudder blade. The flap may also be locked to the rudder blade.

Solution of the Problem

The present invention relates to a rudder that when used at high speeds is arranged to be attached with its nearest part of the rudder blade fixedly retracted to the vessel's hull, and where the rudder effect produced by changing the rudder profile by turning the leading flap and trailing (astern) flap in the direction of the desired turn of the vessel's bow, instead of turning the whole rudder plate to an attacking angle with respect to the direction of speed. In the mentioned retracted position the turning of the leading and trailing (astern) flap will guide the water current past the rudder in such a way that the water speed past the rudder on its two surfaces become different. Thus the pressure effects of the two water currents are that a resultant force component arises, the force component being normal to the rudder side and athwart of the water current on the most convex surface at every instant. The rudder is fixed to the hull at high speeds by means of a telescopic rudder stem, possibly by additional attaching means. This gives the rudder a reduced area within the water current,

SUMMARY OF THE INVENTION

The present invention defines a rudder device of the kind of which the one end is connected to the hull and comprising a main rudder body and one or more rudder flaps which may be turned with respect to the main rudder body. The new and unique feature of the invention resides in that the main rudder body has a fixedly anchored centre position with respect to the hull, with a rudder flap providing the steering effect at high speeds, and that the main rudder body may be loosened from its fixedly anchored centre position and arranged to be turned as a whole in the known way, especially for steering the vessel at low speeds.

More details on new and distinctive characteristics of the embodiment according to the invention are found in the patent claims.

BRIEF DESCRIPTION OF THE DRAWINGS

The invention is described below with reference to the drawings. Several distinctive traits and advantages will appear from the description of detail in connection to the drawings.

Overview of the Drawings.

DETAILED DESCRIPTION OF THE PREFERRED EMBODIMENT

The present invention relates to a rudder that when used at high speeds is arranged to be attached with its nearest part of the rudder blade fixedly retracted to the vessel's hull, and where the rudder effect is produced by changing the rudder profile by turning the leading flap and trailing (astern) flap in the direction of the desired turn of the vessel's bow, instead of turning the whole rudder plate to an attacking angle with respect to the direction of motion. In the mentioned retracted position, the turning of the leading and trailing (astern) flap will guide the water current past the rudder in such a way that the water flowing past the rudder on its two surfaces becomes different. Thus the pressure effects of the two water currents are such that a resultant force component arises, the force component being normal to the rudder side and athwart of the water current on the most convex surface at every instant. The rudder is fixed to the hull at high speeds by means of a telescopic rudder stem, possibly by additional attaching means. This gives the rudder a reduced area within the water current, thus reducing friction.

At low speed the rudder is pushed in the direction away from the hull and is released from its previously fixedly anchored center position. By this release, two mutually cooperating effects arise simultaneously: the rudder blade gets a larger effective area in the water current, and the main rudder blade may be turned about the rudder stem as a conventional rudder. Additional effect of the rudder under low speed is achieved by conventional use of the leading and trailing rudder flaps on the main rudder blade.

The encasing in the hull provides an increased force load capacity both in the speed direction and the athwart direction. Retracting the rudder partially into the hull in an encasing recess also reduces the rudder surface and thus the friction forces with respect to the water cut through by the rudder.

Figure 1:
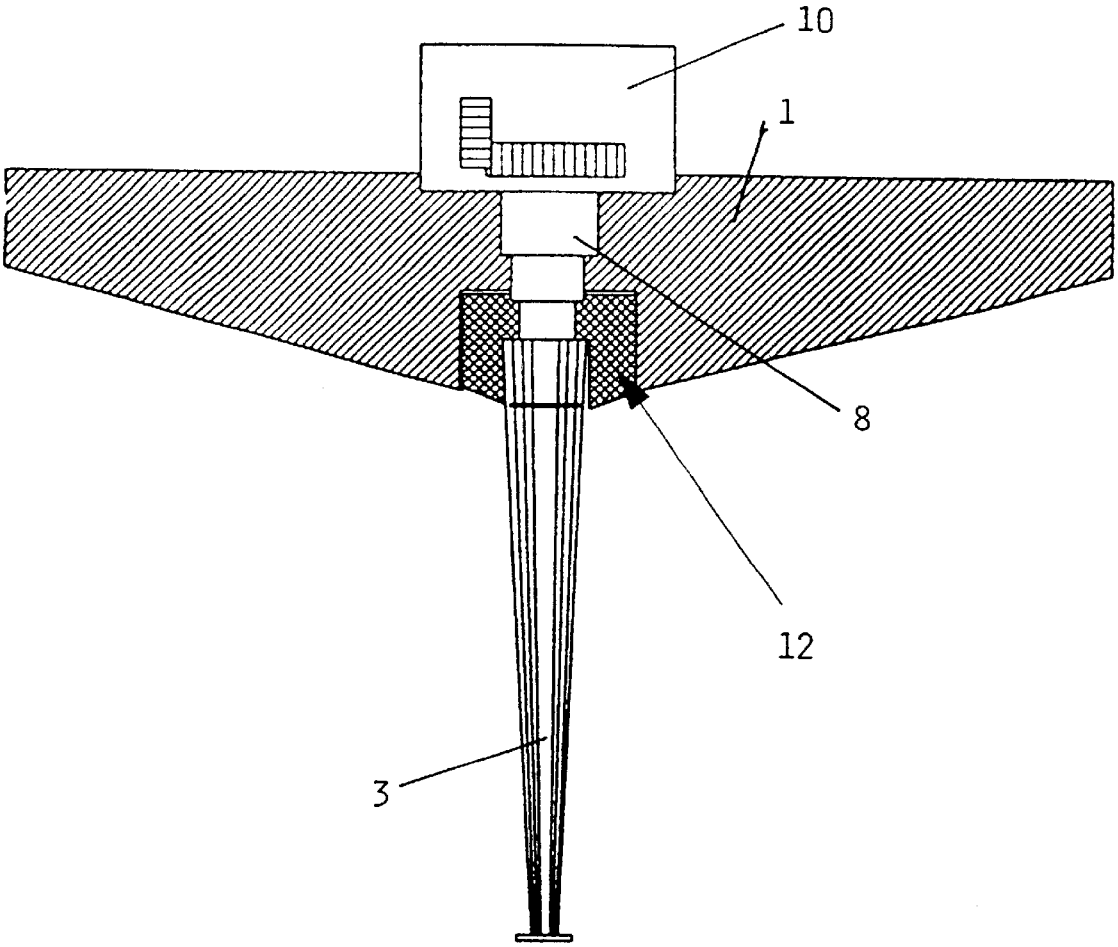
FIG. 1 displays a vertical partial cross-section of the vessel and the rudder device according to the invention.

In FIG. 1 the rudder blade is denominated 3 and this has a corresponding rudder stem 8. The vessel's hull 1 has a hull recess 12 wherein the rudder may be withdrawn by means of the telescopic rudder stem 8. The rudder stem 8 and thereby the rudder 3 may not be turned when the rudder is withdrawn into the hull recess 12.

Figure 2:
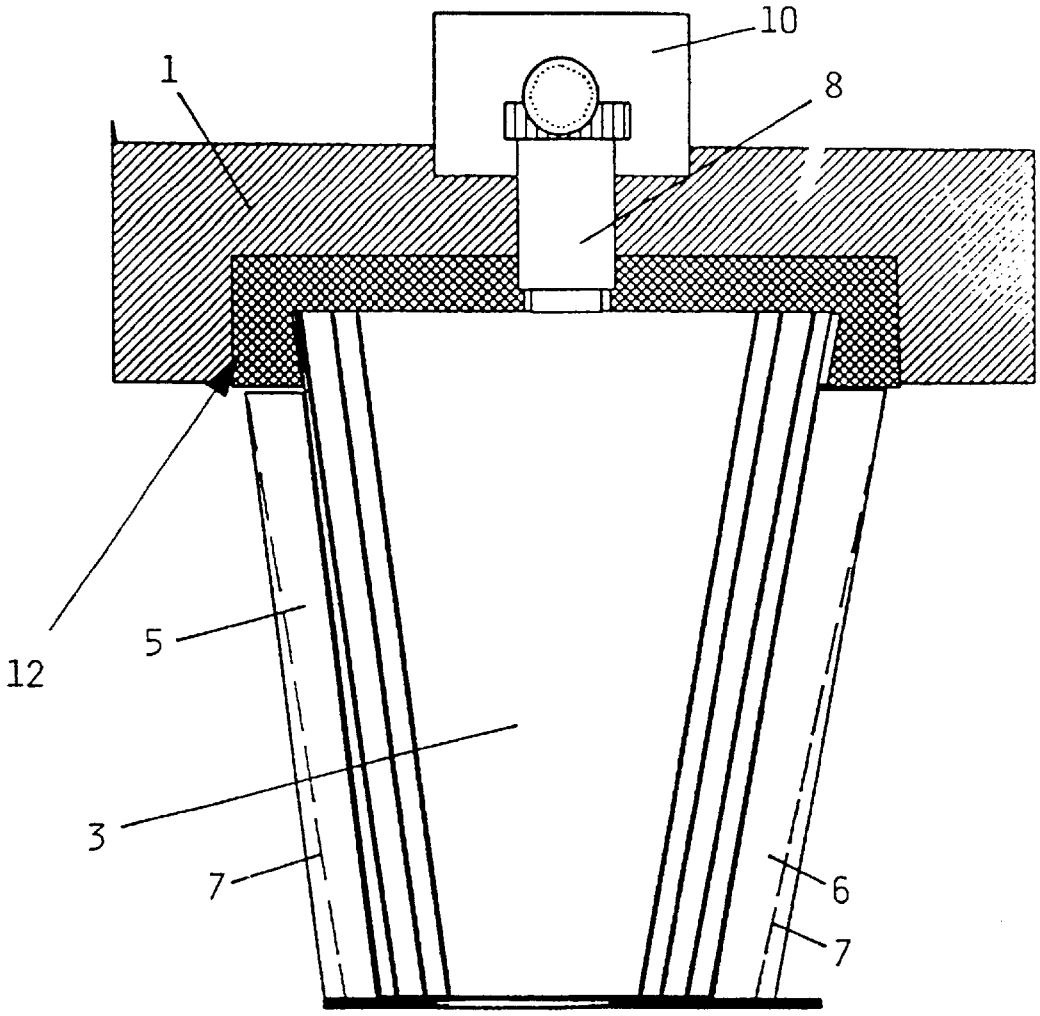
FIG. 2 displays the device of FIG. 1 in a side elevation view and a vertical section along the vessel.

FIG. 2 displays a longitudinal section of the hull 1, the steering engine 10, the rudder stem 8 and the hull recess 12, and an elevational view of the rudder blade 3 with the substantially vertically journalled bearing held leading and trailing rudder flaps or wings S and 6.

Figure 3:
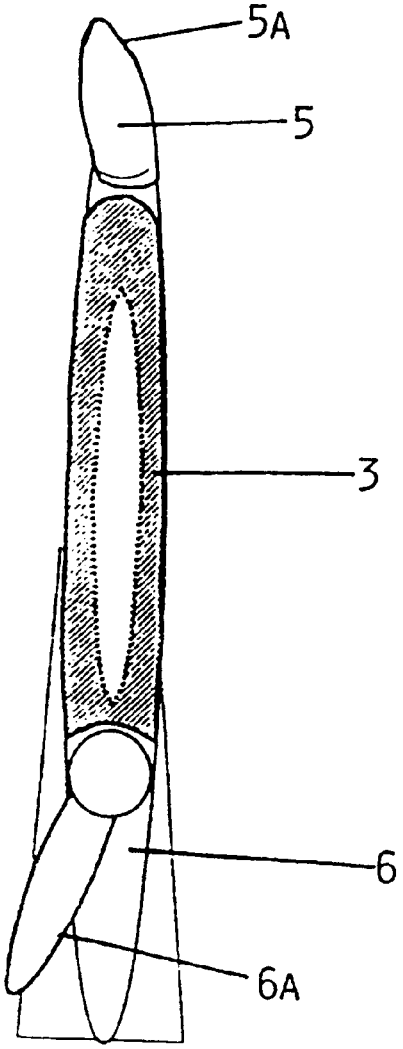
FIG. 3 is a horizontal section of the rudder device with the turnable rudder flaps in a starboard "lift" force position according to the invention.
Figure 5:
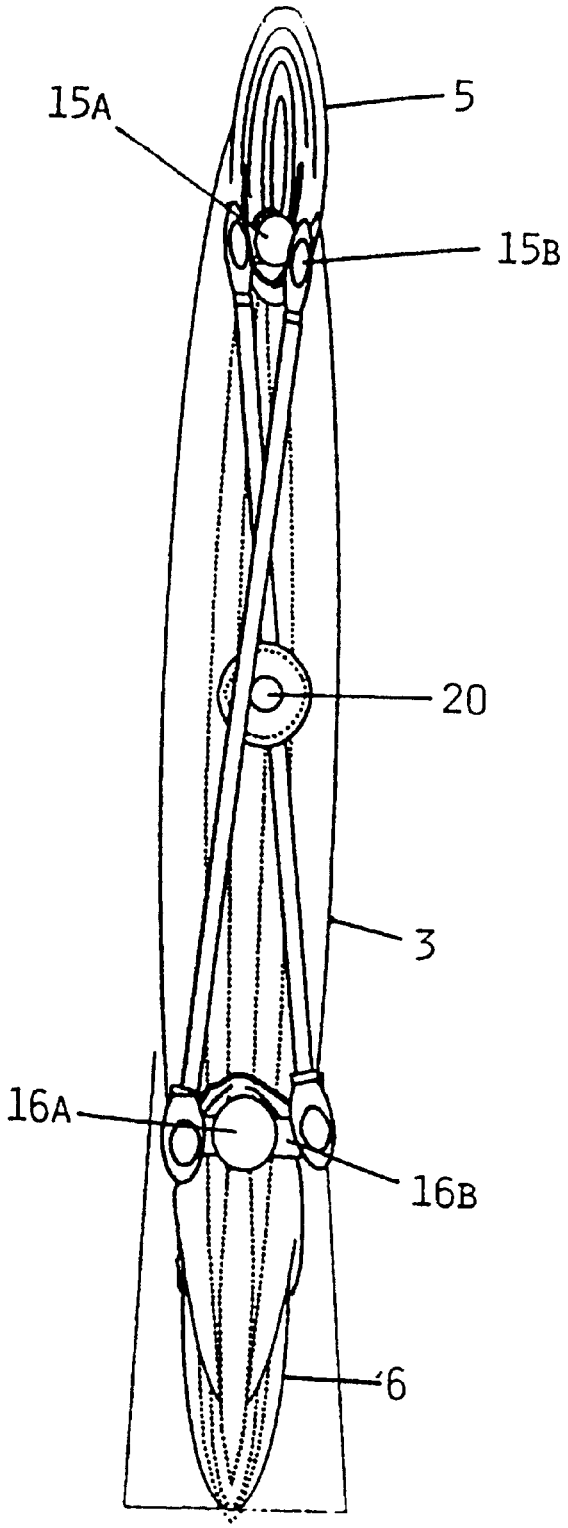
FIG. 5 displays a partial horizontal view of the upper side of the device comprising a stay with a rack and pinion.

FIG. 3 displays a horizontal section of the rudder with the rudder flaps in a starboard "lift" force position with the leading rudder flap SA and the trailing rudder flap 6A turned toward the port side. The neutral direction of the trailing rudder flap 6 is shown. The trailing rudder flap is mounted turnable relative to the axle element 16 (FIG. 5). This configuration will give the vessel a change of course to the port side if the rudder is mounted astern.

Figure 4:
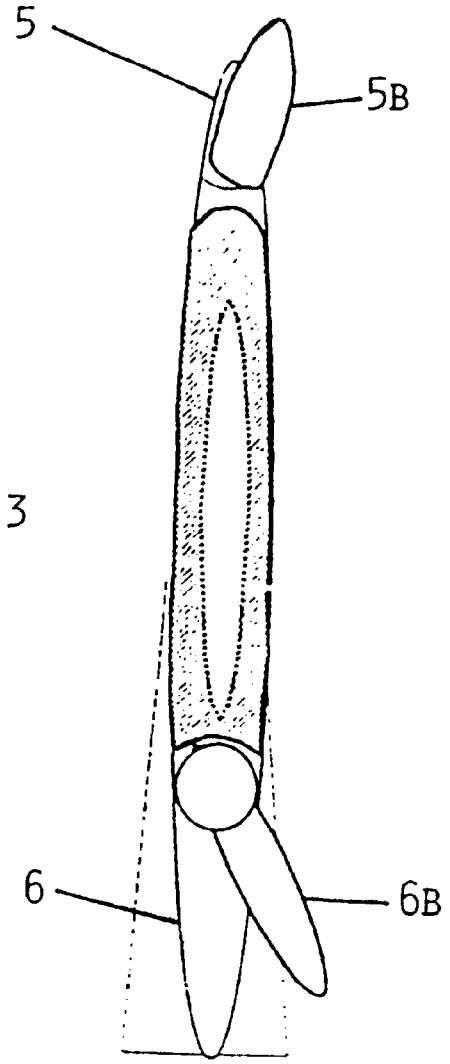
FIG. 4 shows, corresponding to FIG. 3 the turnable rudder flaps in a "lift" force position to the port side.

FIG. 4 shows a section corresponding to FIG. 3, with the rudder flap in a port "lift" force position. This configuration will give the vessel a starboard change of course if the rudder is mounted astern. The rudder flaps here are shown in a starboard position for the leading SB and trailing 6B positions, with the neutral position 6 shown.

FIG. 5 shows a partial view with the rudder seen from above, with the rudder flaps 5, 6 connected with each other by means of crossed steering rods 21, 22 pivotally connected to the ends of turning cross bars 15A, B attached to the leading rudder flap and 16A, B attached to the trailing rudder flap. The turning movement of the leading and trailing is done about the axles 15 and 16. The transmission of force from the common turning axle 20 is made via a rack and pinion mechanism via one or more of the steering rods 21, 22. A preferred embodiment has the force transmission via a pinion on the turning axle 20 and one of the steering rods 22.

Figure 6:
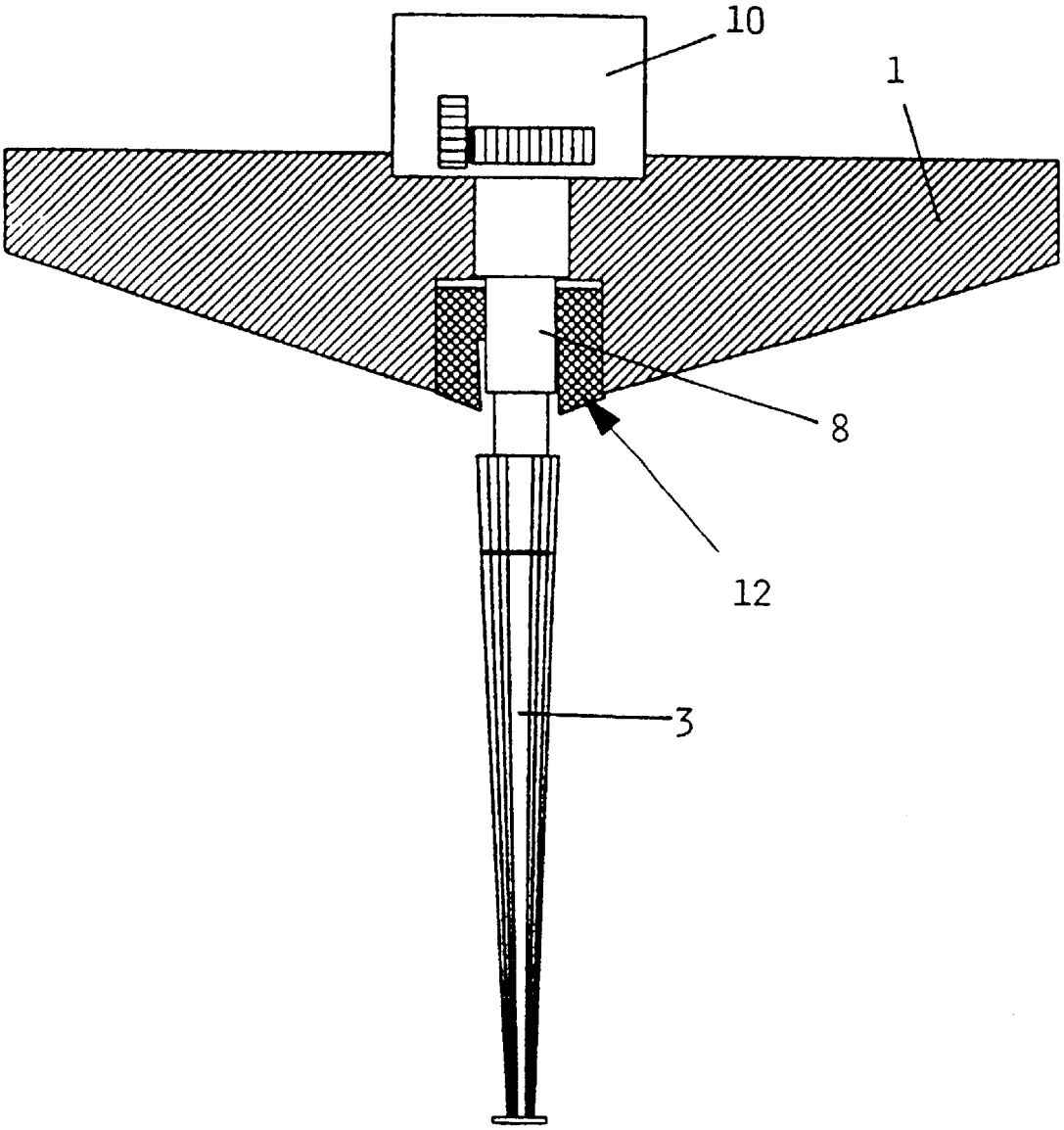
FIG. 6 displays schematically a cross-section of the vessel, the steering engine and the telescopic rudder stem, and a partial elevation view of the rudder in its displaced low-speed position away from the hull, according to the invention.

At low speeds of which one needs a larger efficient rudder area and thus steering effect, the rudder blade according to the invention is displaced by means of the telescoping stem 8 from its fixedly held position in the recess 12 in the hull 1 as shown in FIG. 6, so that the entire rudder 3, 5, 6 may be turned about the telescoping stem which normally is vertical, by means of the steering engine 10.

In a preferred, embodiment the present invention has a slightly tapering-off shape both in breadth and thickness in the direction away from the hull. This tapering-off is preferred in regard to the load that the main rudder blade 3 and its fixation is acted on by those forces that normally arise on a rudder in high speed, and thus the risk of bending the rudder in the vertical plane.

Figure 7:
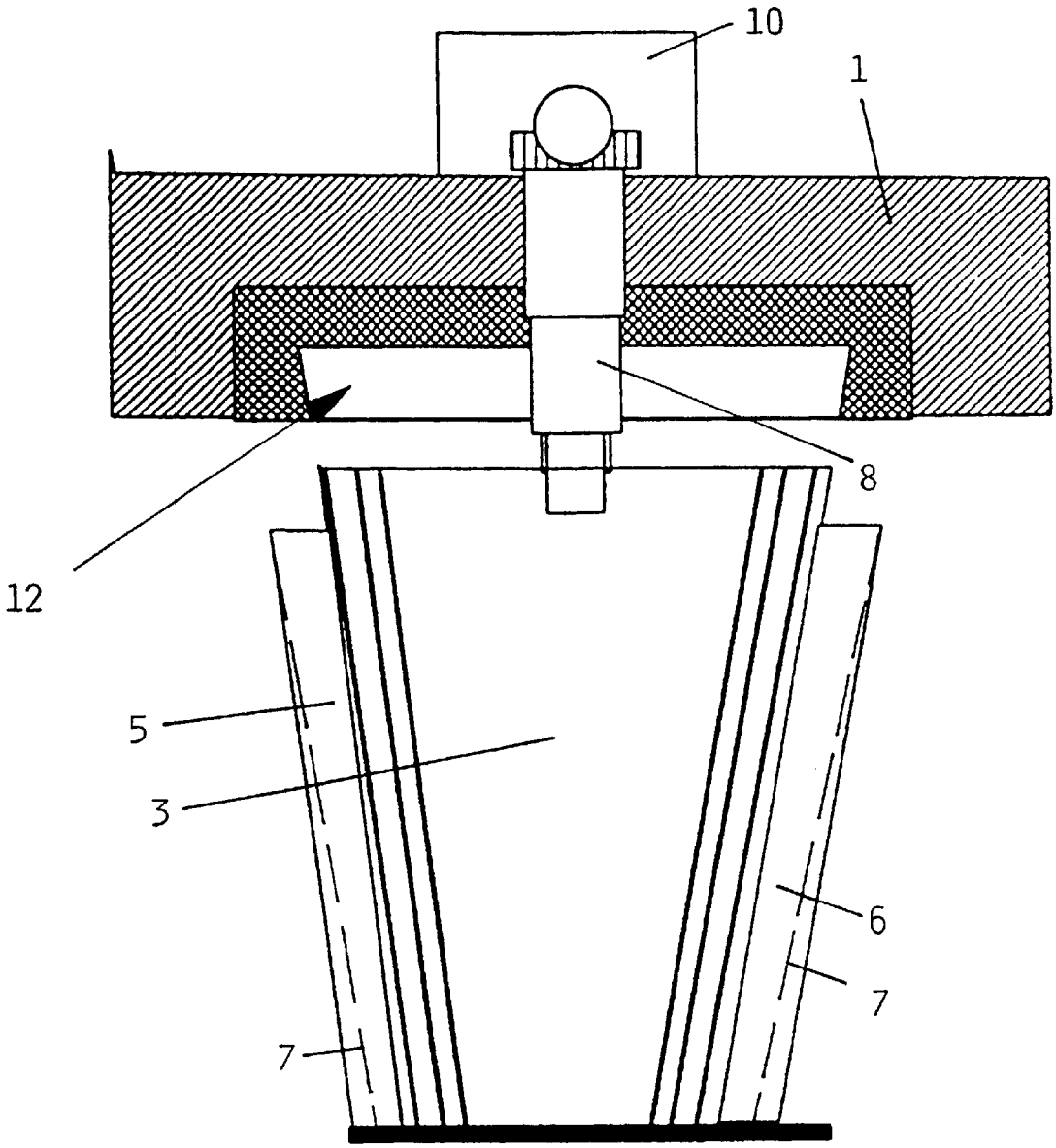
FIG. 7 displays schematically a longitudinal section of the vessel, the steering engine and the telescoping rudder stem, and a partial elevation side view of the rudder in its low speed position, displaced away from the hull.

Continuing the idea of tapering-off of the main rudder 40 blade 3, but independent from whether this is tapered-off or not, is to taper off the rudder flaps 5, 6 due to the same reason as mentioned above, to reduce the bending forces that may arise on rudder flaps. This possible tapering-off is shown by the numeral 7 in the FIGS. 2 and 7.

The present invention may be embodied as one single main rudder mounted on the vessel, or as a double rudder embodied in two essentially parallelly mounted main rudders to achieve the best effect.

The rudder is not limited to an embodiment only as being a ship's rudder, that is, one or more of the ships main rudders mounted astern on the vessel, but is also possible to apply as horizontally or sub horizontally arranged stabilizing flaps to prevent rolling due to sea waves, and preventing heeling over during a change of course.

The invention is not limited to ship rudders, but also comprises a rudder on vessels or underwater gear which may change its depth by means of a horizontal or subhorizontal depth rudder embodied according to the invention, or rudders used as balancing rudders, stabilizing rudders and such, both in driven and towed or pushed vessels and equipment, such as ROV's, submarines and paravanes.

It is evident that the embodiments described in accordance with the drawings, partially are shown and described in a simplified and schematic form in order to describe the principles of the invention. In several traits of the described constructions there are possibilities to perform modifications and to add construction details and still keep the main ideas and solutions which are brought forward in this invention.

What is claimed is:

1. A rudder adapted for steering a vessel with a hull, the rudder comprising:

a main rudder blade arranged on a telescoping rudder stem;

leading and trailing rudder flaps attached to the main rudder blade, said flaps being turnable with respect to said main rudder blade; and said rudder stem being adapted for axial displacement of the main rudder blade between a fixedly anchored center position, wherein the entire upper edge of the main rudder blade is locked within a recess in the hull and the rudder flaps are turnable independent of the main rudder blade, and a free turning position, wherein the main rudder blade is positioned away from the hull for ordinary turning on the rudder stem;

wherein in the fixedly anchored position steering is achieved only with the rudder flaps, and in the free turning position steering is achieved with the main rudder blade and the rudder flaps.

2. The rudder of claim 1, wherein said rudder flaps are turnable while the rudder blade is in the free turning position.

3. A rudder according to claim 1, wherein the main rudder blade is tapered off to a narrower shape in the direction away from the hull.

4. A rudder according to claim 3, wherein said taper is with respect to both width and thickness.

5. A rudder according to claim 1, wherein the rudder flaps are tapered off to a narrower shape in the direction away from the hull.

6. A rudder according to claim 5, wherein said taper is with respect to both width and thickness.

7. A rudder according to claim 1, wherein the rudder flaps are mechanically connected by steering rods and arranged to opposite turning movements forced from a common turning axle.

8. A rudder according to claim 7 characterized by cross-bars attached to each rudder flap with crossed steering rods pivotally connected to their respective ends of the cross-bars, wherein one or more of the steering rods are connected by means of one or more rack and pinion mechanisms with the common turning axle.

9. A vessel with a hull and a rudder adapted for steering the vessel comprising:

a main rudder blade arranged on a telescoping rudder stem;

leading and trailing rudder flaps attached to the main rudder blade, said flaps being turnable with respect to said main rudder blade; and said rudder stem being adapted for axial displacement of the main rudder blade between a fixedly anchored center position, wherein the entire upper edge of the main rudder blade is locked and the rudder flaps are turnable independent of the main rudder blade, and a free turning position, wherein the main rudder blade is positioned away from the hull for ordinary turning on the rudder stem;

further comprising a recess arranged to lock the main rudder blade to the vessel's hull in the fixed anchored center position.

10. A method of steering a vessel including a hull with a rudder comprising a main rudder blade, leading and trailing rudder flaps arranged to be turnable with respect to the main rudder blade, and a telescoping rudder stem arranged for axial displacement of the main rudder blade between a fixedly anchored center position with the rudder blade's entire hull-near end locked to the hull, and a free turning rudder blade position away from the hull comprising the steps of:

fixing said main rudder blade position with the rudder blade's entire hull-near end locked in a recess in the hull and turning said flaps for steering at high speeds; and fixing said main rudder blade position with the rudder in a free turning position for steering at lower speeds.

11. A method according to claim 10, further comprising the step of at low speeds assisting a turn with both the leading and trailing flaps.

12. A method as defined in claim 10, further comprising the step of moving the flaps so that both flaps turn to the same side of said main rudder blade.

* * * * *